United States Patent [19]

Allen

[11] Patent Number: 4,648,190

[45] Date of Patent: Mar. 10, 1987

[54] SINGLE SHOT FALLING BLOCK ACTION

[76] Inventor: Donald L. Allen, White Wood Rd., Sturgis, S. Dak. 57785

[21] Appl. No.: 766,959

[22] Filed: Aug. 19, 1985

[51] Int. Cl.[4] ..... F41C 7/06; F41C 11/04; F41C 15/08

[52] U.S. Cl. ..... 42/23; 42/25

[58] Field of Search ..... 42/25, 23, 24, 46, 47

[56] References Cited

U.S. PATENT DOCUMENTS

| | | | |
|---|---|---|---|
| 33,607 | 10/1861 | Sharps | 42/23 |
| 326,276 | 9/1885 | Davenport | 42/23 |
| 901,043 | 10/1908 | Scott | 42/69.03 X |
| 3,355,833 | 12/1967 | Ruger et al. | 42/23 |
| 3,735,517 | 5/1973 | De Haas et al. | 42/23 |
| 4,270,294 | 6/1981 | Compton | 42/24 |

*Primary Examiner*—Deborah L. Kyle
*Assistant Examiner*—Ted L. Parr
*Attorney, Agent, or Firm*—Orrin M. Haugen; Thomas J. Nikolai; Frederick W. Niebuhr

[57] ABSTRACT

A falling block rifle action which is cocked by the downward movement of the breechblock and which includes a safety mechanism for blocking not only a trigger movement but also the movement of the striker and other interconnecting linkages. An adjustable extractor mechanism coupled to the cocking lever in central relation to the chamber accommodates a wide variety of types and sizes of cartridges.

6 Claims, 2 Drawing Figures

SINGLE SHOT FALLING BLOCK ACTION

BACKGROUND OF THE INVENTION

The present invention relates to breechblock rifles and in particular to a lever-cocked falling block action, including safety means for blocking the movement of not only the trigger, but also the striker and interconnecting moving parts, and including a centrally mounted adjustable ejector mechanism.

Over the years, a variety of breechblock rifle actions have been developed and which have generally been classified into a variety of different types of actions. The specific type of action is typically determined by the type of movement imparted to the breechblock as the breechblock moves into engagement with and disengagement from the cartridge chamber. Some of the commonly known types of actions are the swinging block action, the rolling block action and the falling block action. Within these types of actions, then, numerous designs have been developed by gunsmiths around the world.

One particular falling block design that has been popularized in the United States in recent times is the Ruger No. 1 Falling Block Action and which comprises a lever actuated single shot mechanism having a breechblock contained, spring biased firing pin mechanism. This action is described, among other places, in U.S. Pat. No. 3,355,833. Necessary spring pressure for performing the cocking and ejecting functions is obtained via attendant springs mounted forward of the receiver, beneath the barrel. While over the years this action has generally proven to be reliable, it requires a significant number of piece parts and close tolerance manufacturing to ensure the smooth operation of one to the other.

A variety of other falling block actions of which Applicant is aware of are the Kettner action, the Guedes action, a variety of German actions, the Lechner action and the Hagn action, to name but a few of the many falling block actions that have been developed over the years. A description of these actions can be formed in *Single Shot Rifles and Actions,* by F. deHass (1969).

In an effort to improve upon these various actions, the present invention provides another lever actuated falling block action which has been designed in combination with some of the features of its predecessors and with added features being provided to achieve a new improved action that is relatively easy to manufacture and which exhibits a relatively light weight and aesthetically pleasing design, while accommodating a broad range of calibers. Thus, the present falling block action is adaptable to a wide variety of caliber cartridges and associated stock designs.

Briefly, the present invention provides a falling block action with an improved safety arrangement and extractor design. The overall design further contributes to improved motion for the hammer. For example, in the past known safety systems were designed to block only the movement of the trigger, while the design of the present structure provides an arrangement for blocking not only trigger motion, but also the hammer and its connecting springs and mechanical linkages. The extractor linkage of the falling block action of the present invention provides line pressure on the rim of the case, thus providing for a strong extraction. Furthermore, the extractor device is designed to be adjustable with respect to its degree of "bite" on the rim of the case, so as to accept rimmed, rimless, as well as cartridges having rims of different sizes.

With respect to the mechanism for controlling hammer motion, the falling block action of the present invention permits the hammer to be cocked directly by downward movement of the breechblock, thus providing for a reduction in size and weight, while accommodating more rapid movement of the mechanism.

The above objects, advantages and distinctions of the present invention over the prior art, among others, as well as its particular construction, will become more apparent upon directing attention to the following description thereof with respect to the appended drawings. Before referring thereto, however, it is to be recognized that the following description is made by way of reference to the presently preferred embodiment only and which is not intended to be all inclusive in its description. Accordingly, the following description should not be interpreted in any way to be self-limiting.

SUMMARY OF THE INVENTION

A single shot lever actuated falling block action where the breechblock includes an arcuate, gravity mounted firing pin. A linkage coupled between the cocking lever and the breechblock vertically operates the breechblock relative to the cartridge chamber and causes the ejection of the spent cartridge and cocking of the trigger mechanism upon being extended to its forwardmost position. The ejector is pivotally mounted to and actuated by the counterclockwise actuation of the cocking lever. An associated adjustment screw permits the adjustment of the ejector to accommodate a variety of cartridge types.

A main spring containing mechanism coupled to a pivotally mounted striker, extends rearwardly of the striker and is mounted in a ball and socket fashion to the receiver. The striker is cocked with the falling action of the breechblock and the trigger is engaged via an intermediate sear and sear link coupled therebetween, spring tension is provided to the trigger via the counteracting force of the sear on the striker.

A tang mounted safety is positioned in overlying relation to the sear to prevent the pivotal rotation and release of the striker, when in its "safety" position. Thus, the present safety blocks not only the motion of the trigger, but also that of the striker and intermediate interconnecting linkages so as to provide an inherently safe action. In the "fire" position, the safety permits the trigger to pivotally actuate the sear so as to release the striker and which is caused by the main spring to rotate and engage the firing pin and thereby the cartridge.

DESCRIPTION OF THE PREFERRED EMBODIMENT

Figure 1:
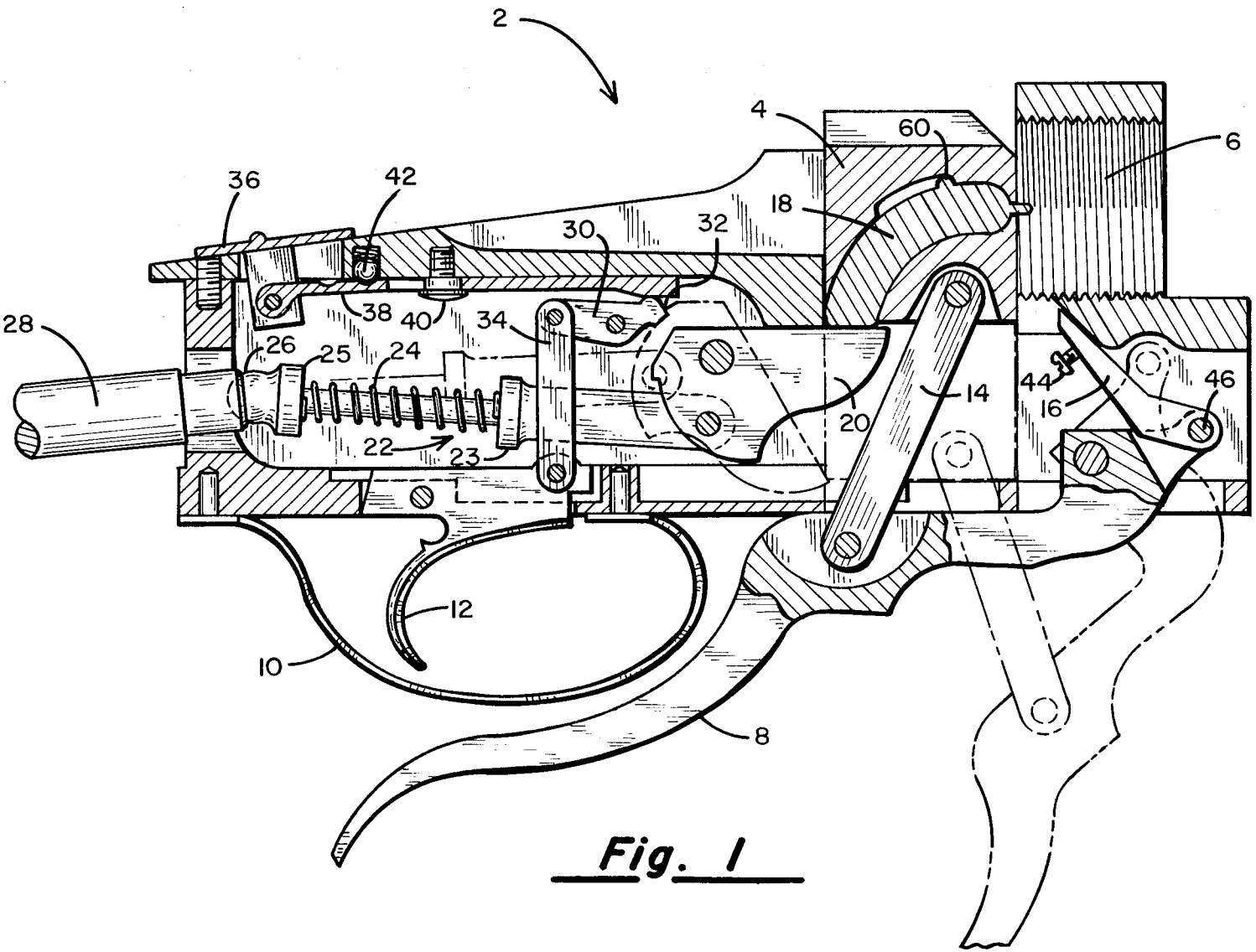
FIG. 1 shows a cross-sectional view through the action of the present invention and wherein the cocked position is shown in dotted line and the uncocked position is shown in solid line relative to the action of the cocking lever.

Turning attention to FIG. 1, a cross-sectional view is shown through the receiver 2 of a rifle constructed in accordance with the teachings of the present invention. For purposes of the present description, the stock and barrel portions of the rifle have been deleted, but it is to be recognized that depending upon the user's wishes and caliber type, they can be adjusted accordingly. From FIG. 1, the present falling block action is shown as it would appear after being fired and as it is when being re-cocked and wherein the fired position is shown in solid line and the re-cocked position is shown in dotted line. Referring first to the fired position, this position equates with the breechblock 4 being positioned in its uppermost position relative to the receiver 2 and in covering relation to the cartridge chamber 6. The cartridge chamber being shown only in relation to the threaded region whereat the barrel would be secured to the receiver 2, in that the chamber itself is formed in the barrel. In this position, the cocking lever 8 is pivoted to its clockwisemost position so as to abut against the bottom of the receiver 2 in adjacent relation to the trigger guard 10 and trigger 12. In this position, the associated breechblock linkage member 14 is extended to its uppermost position and the ejector arm 16 connected to the fore end of the cocking lever 8 is centrally positioned in a recess formed in the receiver 2 beneath the cartridge chamber in non-contacting relation to the cartridge. The firing pin 18, which is gravity mounted in the breechblock 4 rests at the uppermost point of the arc of its path of travel in resting relation on the striker 20.

The trigger assembly, meanwhile, is positioned in uncocked relation to the firing pin 18. That is, the main spring retainer 22 and main spring 24 have been pivoted downward relative to the striker 20 and the ball and socket connection 26 at the stock retainer 28. In this position, the striker 20 rests in horizontal relation in receiver 2 with the flat end surface of the striker 20 contacting the firing pin 18. The spring force induced by the main spring 24 maintains this uncocked position, until the action is re-cocked with the striker 20 being rotated clockwise until the sear 30 re-engages the notch 32 in the striker 20. Upon again pulling the trigger 12, the sear link 34 and sear 30 are released, which causes the sear 30 to rotate counterclockwise and release the striker 20. The striker 20 then rotates with a force determined by the main spring 24 to strike the firing pin 18 and cause it to engage the cartridge. At the same time, the main spring retainer 22 rotates downwardly with the striker 20 in the position shown.

Mounted in overlying relation to the sear 30 is a tang mounted, thumb-actuated safety 36 and which may be slidably actuated from a leftmost "safe" position to a rightmost "fire" position. The safety 36 is coupled to a safety slide member 38 and which is mounted within the hollow of the receiver 2 in overlying relation to the sear 30 so as to slide into and out of contact therewith. Specifically, the rightmost end of the slide member 38 includes a thickened portion which when the safety is in the "safe" position contacts the sear 30 to prevent its release from its notched engagement with the striker 20. In the rightmost "fire" position, a thinner portion of the slide member 38 is presented to the sear 30 and which permits the sear 30 to rotate counterclockwise and release the striker 20.

The sliding action of the safety 36 occurs relative to a retaining screw 40 mounting through a slot in the slide member 38 to the receiver 2. A spring loaded ball 42 mounted in the receiver in contacting overlying relation to the slide member 38 and a pair of detents formed therein positively engages the slide member 38 at the respective "safe" and "fire" positions. Similarly, a spring loaded ball (not shown) mounted relative to the breechblock 4 and a pair of indentations formed in the breechblock surface adjacent the cartridge chamber (not shown) positively engage the breechblock 4 when the cocking lever 8 is positioned in its leftmost and rightmost positions so as to prevent against the inadvertent rotation thereof.

Once the present action has been fired, it is necesary to grasp and pivot the cocking lever 8 in a counterclockwise direction to its forwardmost position and which motion via the breechblock linking arm 14 causes the breechblock 4 to be vertically lowered and which action causes the striker 20 to be tipped and rotated back to its cocked position relative to the sear 30. At the same time, the ejector 16 mounted to the forward end of the cocking lever 8 is caused to rise slightly so as to engage the rim of the cartridge or cartridge body. With additional motion of the cocking lever 8, the ejector 16 rotates slightly and which motion disengages and extracts the cartridge from the chamber 6. By appropriately adjusting the screw 44 mounted within the receiver 2 adjacent the ejector 16, the amount of ejection force can be adjusted such that the spent cartridge can be ejected completely from the chamber 6 and away from the receiver 2. A new cartridge can then be inserted in the chamber and the cocking lever 8 returned to its cocked position. Relative to the ejector 16, it is to be noted that a spring 62 (FIG. 2) mounted around the pin connector 46 causes the ejector to be biased upwardly toward the cartridge.

Figure 2:
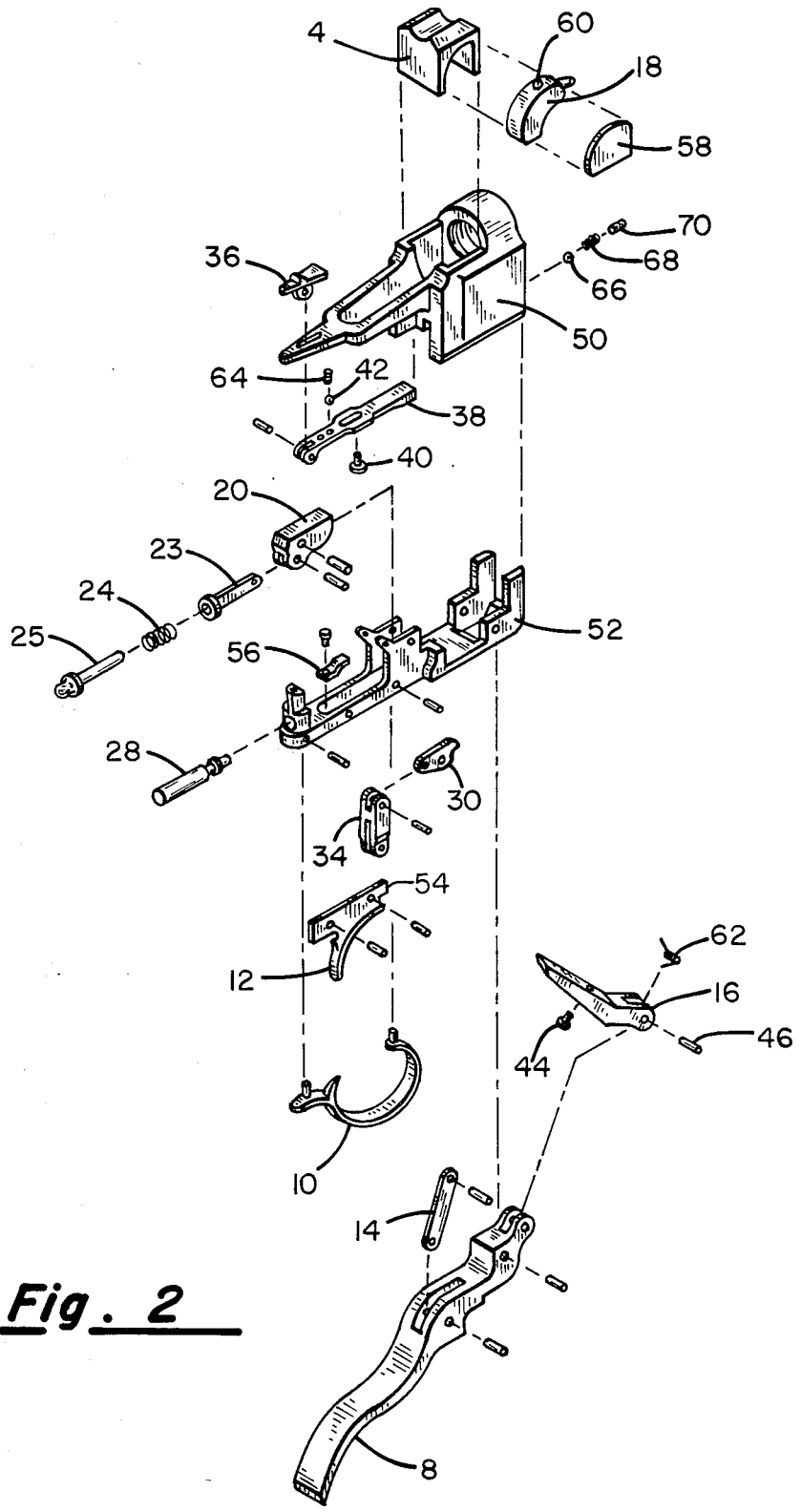
FIG. 2 shows an exploded assembly view of the piece part components which make up the present action.

Turning attention next to FIG. 2, a perspective assembly view is shown of the action described in FIG. 1. From FIG. 2, a better understanding can be had as to the mounting relation of the individual piece part components to each other and the construction thereof. Briefly discussing these, it is to be noted that the receiver 2 is machined in two parts and which comprise an overlying barrel receiving portion 50 and a lower lying trigger receiving portion 52. The main spring retainer seat 28 being mounted to the leftmost end of the lower lying portion 52 and the forward end of the cocking lever 8 being pivotally restrained at the rightmost end of the lower lying portion 52. The trigger guard 10 is pin-mounted to the bottom of the lower lying receiver portion 52 and surrounds the trigger 12, which also is pin-mounted therein. The sear link 34 and sear 30 are pin-mounted to the trigger 12 at its forward end behind a flange 54 thereof which contacts and rotates the sear link 34. A screw mounted leaf spring 56 mounted in overlying relation to the trigger 12 slightly biases the trigger 12 so as to induce a desired trigger pull resistance. The breechblock 4, in turn, is slidably mounted within a machined slideway formed into the overlying receiver portion 50. A cover plate 58 mounted to one side thereof and which is shown removed, protects the arcuate firing pin 18 and which is gravity mounted in a mating arcuate path machined into the breechblock 4. The striker 20, in turn, is mounted to the lower lying receiver portion 52 such that when the sear 30 is released therefrom, it will rotate and strike the lower lying end of the firing pin. It is to be noted that the firing pin 18 includes a small projection 60 formed along an exterior surface thereof, rides in a recess in the breechblock and which at one end of the recess, prevents the firing pin from falling from the breechblock 4, when the striker is pivoted to its cocked position. The other end of the recess, in turn, limits the forward travel of the firing pin 18.

Coupling the breechblock 4 to the cocking lever is the breechblock linkage 14 and which is pin-mounted within mating recesses in the cocking lever 8 and the breechblock 4. A pin mounted to the fore end of the cocking lever 8 restrains the cocking lever to the lower lying trigger receiving portion 52. The ejector 16 and the spring 62 are mounted about the pin connector 46. The ejector adjustment screw 44 being mounted therebeneath so as to permit the setting of the ejector mounting angle relative to the chamber 6. The extreme end of the cocking lever 8, in turn, is a slightly raised portion and which upon the rotation of the cocking lever acts to engage the ejector 16 so as to induce a counterclockwise movement thereat, with the subsequent removal of the cartridge from the chamber 6. Also, shown in FIG. 2 are the biasing spring 64 for the safety detent and the ball 66, spring 68 and screw cap 70 which coact with the detents formed in the falling block 4.

While the present invention has been described with respect to its presently preferred embodiment, it should be recognized that various modifications can be made thereto by those of skill in the art without departing from the spirit and scope thereof. It is accordingly contemplated that the following claims should be included so as to include all those equivalent embodiments within the spirit and scope thereof.

What is claimed is:

1. A falling breechblock receiver action for a rifle comprising in combination:

a breechblock slidably vertically mounted in a receiver relative to a cartridge receiving chamber, said breechblock having an arcuate first recess formed therein and extending from a lower surface to a side surface adjacent said cartridge chamber and further including a second recess overlapping said first recess over a predetermined portion thereof;

a cocking lever pivotally mounted to said receiver for movement between a rearward position and a forward cartridge eject position, and a linkage arm pivotally coupled at opposite ends to said cocking lever and to said breechblock;

an ejector member pivotally mounted to a fore end of said cocking lever and within a recess formed in said receiver for engaging and rearwardly moving a cartridge from said chamber, upon moving said cocking lever to said cartridge eject position;

an arcuate, gravity mounted firing pin mounted to slide in said first recess and including a projection therefrom contained in said second recess for limiting the path of travel of said firing pin;

a striker pivotally mounted to said receiver and positioned to strike said firing pin upon being released from a cocked position, said striker including a notch formed in an exterior surface thereof for releasably engaging a sear member pivotally mounted to said receiver;

spring means movably mounted in said receiver for biasing said striker toward an uncocked position while maintaining said striker in said cocked position, and for causing said striker to strike said firing pin when released from said cocked position;

a trigger, and a sear link connected to said sear member and said trigger for pivoting said sear member responsive to moving said trigger; and safety means mounted in overlying relation to said sear member for preventing the release of said sear member from the notch of said striker, thus to retain said striker in said cocked position, when in its safe position and for permitting the release of said striker in its fire position.

2. Apparatus as set forth in claim 1 further including:

means for spring biasing said ejector member into engaging relation with said cartridge; and adjustment means within said receiver for adjusting the orientation of said ejector member when said cocking lever is in its rearward position.

3. Apparatus as set forth in claim 1 wherein said spring means comprises a first elongated portion coupled to said striker and extending rearwardly therefrom, a second intermediate portion of lesser diameter than said first portion slidably mounted within said first portion and having a main spring concentrically mounted therearound, said spring at one end abutting said first portion, and a third portion mounted to said receiver in a ball and socket fashion and abutting an opposed end of said mainspring, said spring means rotating with said striker as it moves from its cocked to its uncocked positions.

4. Apparatus as set forth in claim 1 wherein said safety means comprises a tang mounted, thumb actuated safety member and a slide member slidably mounted along an upper horizontal surface of said receiver and including first and second detents formed therein, said slide member including a relatively thick distal end in the region of said sear member, whereby said relatively thick distal end prevents said sear member from being moved to release said striker when said thick distal end is positioned in overlying relation to said sear member and otherwise permits movement of said sear member to so release when a relatively thinner portion of said slide member is positioned thereover.

5. Apparatus as set forth in claim 4 including a spring loaded ball mounted in said receiver along the path of travel of said slide member so as to positively engage said first and second detents of said slide member at the respective safe and fire positions.

6. Apparatus as set forth in claim 1 wherein said receiver includes a spring mounted ball mounted in adjacent relation to said breechblock and said breechblock includes first and second detents formed therein, such that said ball engages said first and second detents relative to the movement of said cocking lever so as to restrain said breechblock when said cocking lever is in its rearward position and in its forward position, respectively.

* * * * *